US008310406B2

(12) United States Patent
Yanagi et al.

(10) Patent No.: US 8,310,406 B2
(45) Date of Patent: Nov. 13, 2012

(54) ANTENNA DEVICE

(75) Inventors: Masahiro Yanagi, Shinagawa (JP); Shigemi Kurashima, Shinagawa (JP); Takashi Yuba, Shinagawa (JP); Satoshi Sakurai, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/216,376

(22) Filed: Jul. 2, 2008

(65) Prior Publication Data

US 2009/0140948 A1 Jun. 4, 2009

(30) Foreign Application Priority Data

Nov. 30, 2007 (JP) ..... 2007-311451

(51) Int. Cl.
*H01Q 1/48* (2006.01)

(52) U.S. Cl. ..... 343/846; 343/848

(58) Field of Classification Search ..... 343/878, 343/700 MS, 702, 789, 846, 848
See application file for complete search history.

(56) References Cited

U.S. PATENT DOCUMENTS

| | | | | |
|---|---|---|---|---|
| 6,985,114 | B2 | 1/2006 | Egashira | |
| 7,196,674 | B2 * | 3/2007 | Timofeev et al. | 343/810 |
| 7,436,360 | B2 * | 10/2008 | Chen et al. | 343/700 MS |
| 7,782,601 | B2 * | 8/2010 | Cho | 361/679.21 |
| 2006/0097925 | A1 * | 5/2006 | Lee | 343/700 MS |
| 2008/0122720 | A1 * | 5/2008 | Liao | 343/846 |
| 2008/0231520 | A1 * | 9/2008 | Zueck et al. | 343/702 |
| 2008/0316115 | A1 * | 12/2008 | Hill et al. | 343/702 |
| 2009/0213012 | A1 * | 8/2009 | Jiang et al. | 343/700 MS |
| 2010/0081491 | A1 * | 4/2010 | Lee | 455/575.7 |

FOREIGN PATENT DOCUMENTS

| | | |
|---|---|---|
| JP | 2000-196327 | 7/2000 |
| JP | 2002-330019 | 11/2002 |
| JP | 2005-5780 | 1/2005 |
| JP | 2007-142974 | 6/2007 |

OTHER PUBLICATIONS

T. Taniguchi et al., "An Omnidirectional and Low-VSWR Antenna for the FCC-Approved UWB Frequency Band" IEICE General Conference, Mar. 22, 2003.

Japanese Office Action dated Dec. 16, 2011 issued in corresponding Japanese Patent Application No. 2007-311451.

* cited by examiner

*Primary Examiner* — Jacob Y Choi
*Assistant Examiner* — Kyana R McCain
(74) *Attorney, Agent, or Firm* — Staas & Halsey LLP

(57) ABSTRACT

A disclosed antenna device includes a ground section; and an element section projecting from the ground section. The length of the ground section in a direction orthogonal to a side of the ground section from which side the element section projects is less than approximately ¼ a corresponding wavelength. The ground section is configured to be disposed over and attached to a conductive section.

19 Claims, 8 Drawing Sheets

ANTENNA DEVICE

BACKGROUND OF THE INVENTION

1. Field of the Invention

The present invention generally relates to an antenna device, and particularly relates to an antenna device including a ground section and an element section.

2. Description of the Related Art

Recently, with the development of computers and peripheral devices, it has been desired to connect computers to peripheral devices without using cables.

As a technology for performing wireless communications between computers and peripheral devices, an Ultra-Wide Band (UWB) technology is drawing attention in that UWB enables communications with high transmission capacity. The use of the UWB in a frequency band of 3.1-10.6 GHz was approved by the U.S. Federal Communication Commission (FCC) in 2002.

The UWB system is a communication system for transmitting pulse signals in an ultra wide band. Therefore, antennas for UWB communications need to have a structure that allows transmission/reception of the pulse signals in the ultra wide band.

As an antenna to be used at least in the frequency band of 3.1-10.6 GHz approved by the FCC, Non-patent Document 1 discloses an antenna in which a conical or teardrop-shaped power feeder is disposed on a flat base plate.

The antenna of Non-Patent Document 1 is, however, large because the conical or teardrop-shaped power feeder is disposed on the flat base plate. It is therefore desired to reduce the size and thickness of the antenna.

Meanwhile, as a loop antenna for communications in a low frequency band, Patent Document 1 discloses an antenna device in which an element section is a conductive pattern formed on a flexible substrate.

Patent Document 1: Japanese Patent Laid-Open Publication No. 2000-196327

Non-Patent Document 1: Takuya Taniguchi and Takehiko Kobayashi (Tokyo Denki University) "An omnidirectional and low-VSWR antenna for the FCC-approved UWB frequency band" proceedings of the IEICE (Institute of Electronics, Information and Communication Engineers) General Conference in 2003 (presented at room 201 on March 22)

SUMMARY OF THE INVENTION

As electronic devices become smaller, it is desired to downsize antenna devices for use in the electronic devices and reduce the attachment space for the antenna devices.

In view of this, the present invention is directed toward providing an antenna device that can be downsized without degrading the performance.

According to an aspect of the present invention, there is provided an antenna device that includes a ground section; and an element section projecting from the ground section; wherein the length of the ground section in a direction orthogonal to a side of the ground section from which side the element section projects is less than approximately ¼ a corresponding wavelength; and the ground section is configured to be disposed over and attached to a conductive section. The length of the element section projecting from the ground section may preferably be less than approximately ¼ a corresponding wavelength.

In the above-described antenna device, the ground section and the element section may preferably be conductive patterns formed on a substrate. The substrate may preferably be flexible.

In the above-described antenna device, the ground section may preferably be configured to be disposed over and attached to the conductive section by interposing a conductive double-faced tape. The element section may preferably include a first element portion projecting from the side of the ground section; and a second element portion connected to an end of the first element portion and extending parallel to the side of the ground section.

In the above-described antenna device, it is preferable that the second element portion extend from the end of the first element portion away from opposite sides of the first element portion. It is also preferable that the second element portion extend from the end of the first element portion away from a side of the first element portion.

The above-described antenna device may constitute an ultra wide band antenna. The conductive section may preferably be a bezel of a display unit.

In the above-described antenna device, the ground section and the element section may preferably be formed by molding a metal material.

In an embodiment of the present invention, an antenna device is provided in which the length of a ground section orthogonal to a side of the ground section from which side an element section projects is made less than approximately ¼ the corresponding wavelength. The ground section is disposed over and attached to a conductive section, so that the conductive section can serve as a ground of the antenna device. This allows downsizing the antenna device.

DETAILED DESCRIPTION OF THE PREFERRED EMBODIMENT

Figure 1A:
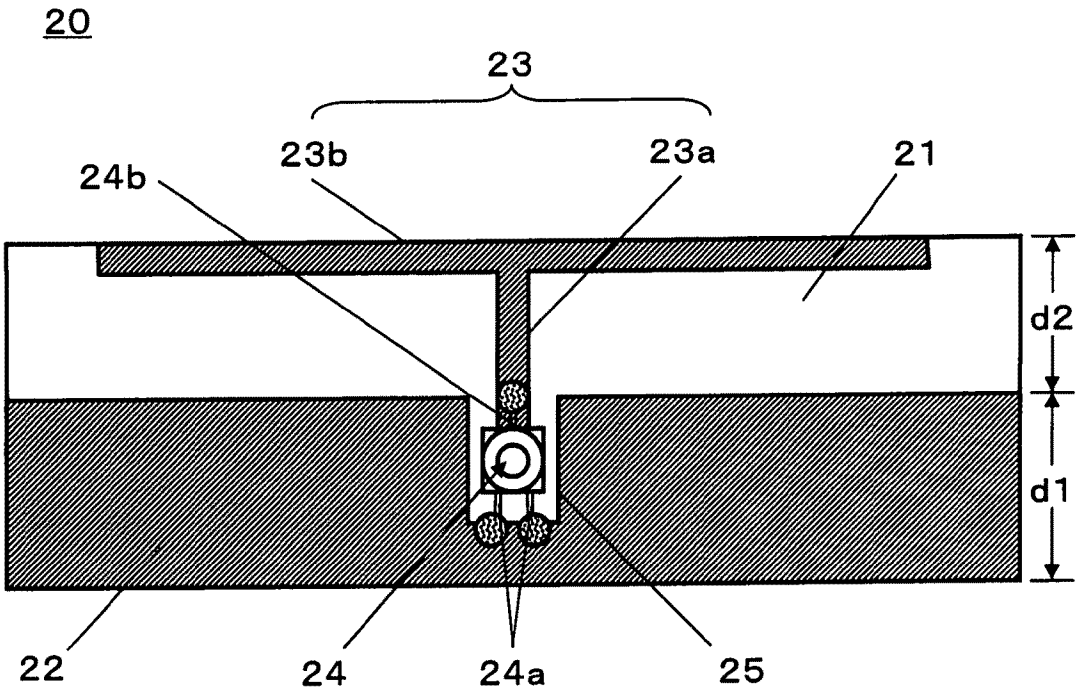
FIGS. 1A and 1B are diagrams illustrating the configuration of an antenna device according to an embodiment of the present invention.
Figure 1B:
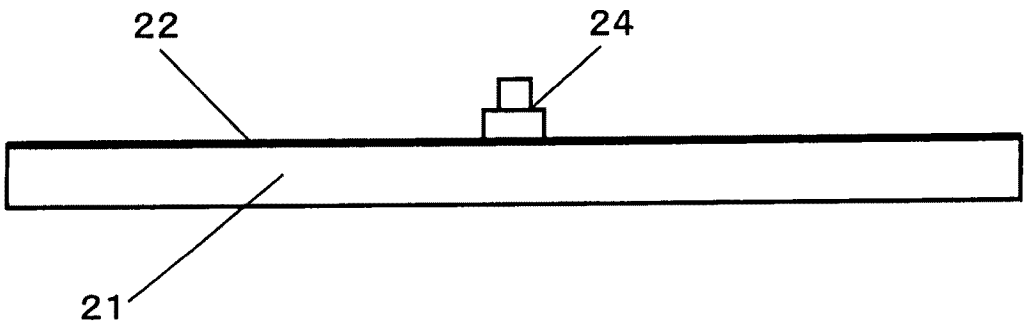

FIGS. 1A and 1B are diagrams illustrating the configuration of an antenna device 20 according to an embodiment of the present invention.

In the antenna device 20 of this embodiment, a ground section 22 (referred to also as a ground pattern 22) and an element section 23 (referred to also as an element pattern 23) are conductive patterns formed on a substrate 21.

The substrate 21 may include a printed wiring board, a flexible printed wiring board, or the like.

The ground section 22 has a substantially rectangular shape, and the element section 23 projects from the ground section 22. A length d1 of the ground section 22 in a direction orthogonal to a side of the ground section 22 from which side the element section 23 projects is made less than approximately ¼ the corresponding wavelength A, i.e., less than approximately λ/4. In this embodiment, for example, the corresponding frequency is 4 GHz and the length d1 is made approximately 10 mm.

The ground section 22 is disposed over and attached to a conductive section such as a bezel of a display device by interposing a double-faced tape so that the antenna device 20 is attached to an attachment section.

In the antenna device 20 of this embodiment, a projecting length d2 of the element section 23 is made less than approximately ¼ the corresponding wavelength λ, i.e., less than approximately λ/4. In this embodiment, for example, the corresponding frequency is 4 GHz and the projecting length is approximately 10 mm. Note that the length of the element section 23 is increased to allow reducing the projecting length d2 of the element section 23, thereby downsizing the antenna device 20 of this embodiment.

In the antenna device 20, the ground pattern 22 and the element pattern 23 on the substrate 21 are formed of a conductive material. A connector 24 is soldered to the ground pattern 22 and the element pattern 23.

For example, the substrate 21 is made of a resin board, such as a polyimide board, and has a width of about 30 mm, a depth of about 20 mm, and a thickness of about 0.1 mm. The substrate 21 may be made of a flexible resin (dielectric) film such as a PET film.

The ground pattern 22, i.e., the ground section 22, of the antenna device 20 is made of a conductive film. The ground pattern 22 is formed across substantially the entire length in a width direction and substantially half the length in a depth direction of the substrate 21.

The element pattern 23, i.e., the element section 23, of the antenna device 20 is made of a conductive film having a width of about 1 mm or less. The element pattern 23 has a first element portion 23*a* and a second element portion 23*b*. The first element portion 23*a* projects from the side of the ground pattern 22 of the substrate 21 in the direction substantially orthogonal to the side of the ground pattern 22. The second element portion 23*b* is connected to an end of the first element portion 23*a* and is aligned substantially parallel to the side of the ground pattern 22. The conductive material forming the ground pattern 22 and the element pattern 23 may be, for example, a metal material such as copper and aluminum.

The first element portion 23*a* and the second element portion 23*b* form the element pattern 23 having a T-shape. The element pattern 23 electromagnetically acts on the ground pattern 22, thereby transmitting and receiving radio waves.

Note that the second element portion 23*b* has a length of about 24 mm parallel to the side of the ground pattern 22 and is spaced apart from the side of the ground pattern 22 by about 9 through 10 mm.

The coaxial plug connecter 24 is fixed to a connector attachment section 25. The connector attachment section 25 is formed, for example, at the side of the ground pattern 22. The connector attachment section 25 is an angular U-shaped notch in the ground pattern 22. The coaxial plug connector 24 is soldered at a ground terminal 24a to the ground pattern 22 and at a signal terminal 24*b* to an end of the first element portion 23*a* of the element pattern 23.

Figure 2:
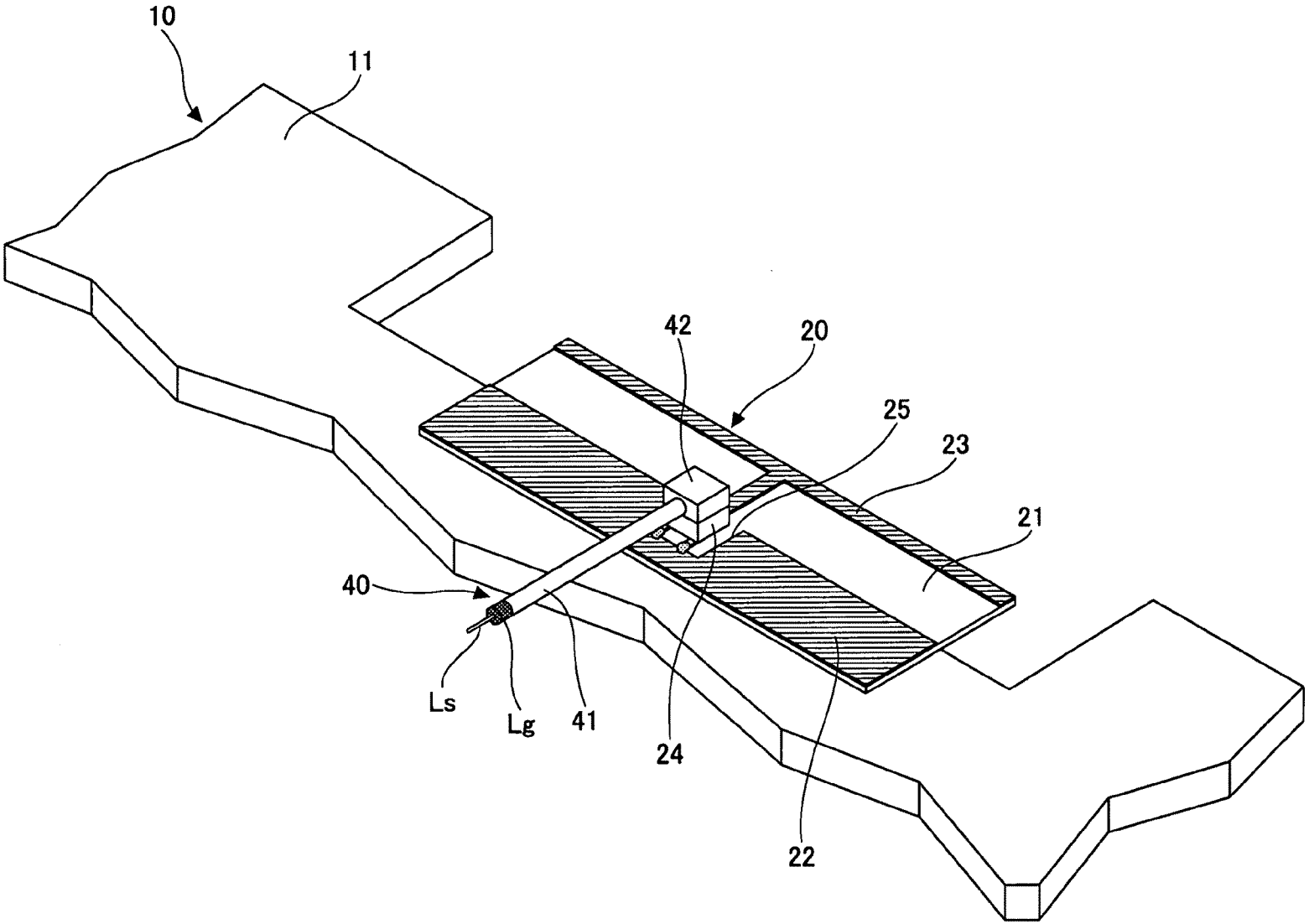
FIG. 2 is a diagram for explaining an attachment structure of an antenna device according to an embodiment of the present invention.
Figure 3:
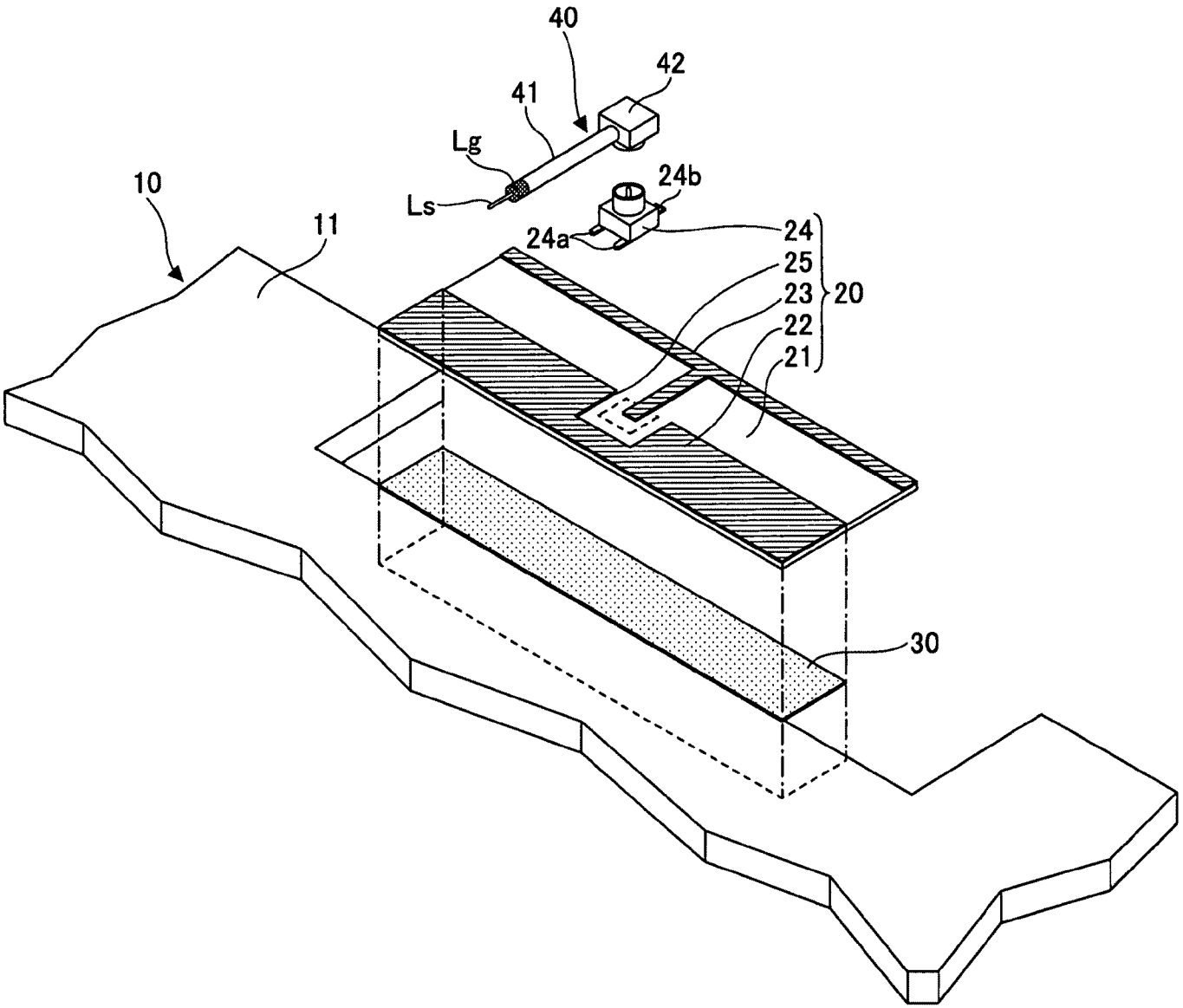
FIG. 3 is a diagram for explaining the attachment structure of the antenna device according to the embodiment of the present invention.
Figure 4A:
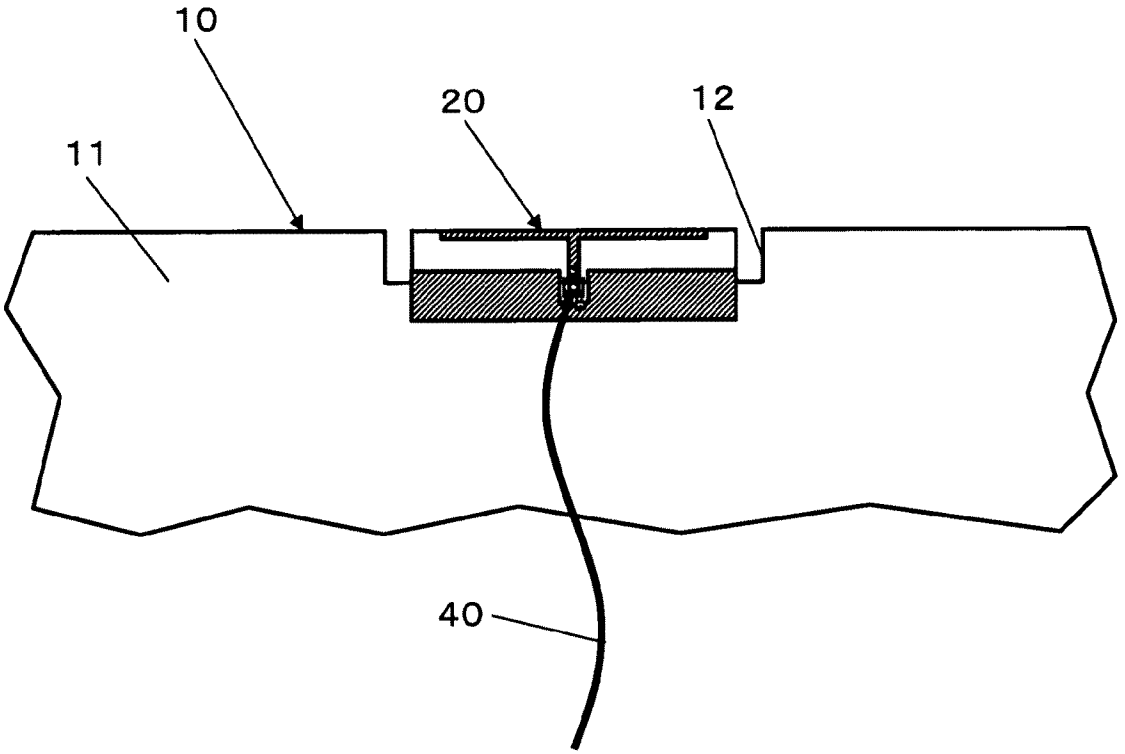
FIGS. 4A and 4B are diagrams for explaining the attachment structure of the antenna device according to the embodiment of the present invention.
Figure 4B:
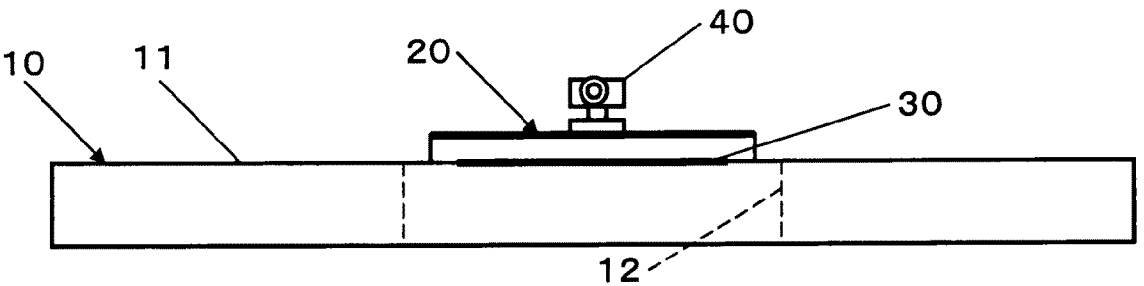

A coaxial socket connector 42 (see FIG. 2), which is connected to an end of a cable 41 of a coaxial cable 40, is attached to the coaxial plug connector 24 so that the coaxial plug connector 24 is connected to the cable 41. The coaxial socket connector 42 is attached to the coaxial plugs connector 24, whereby the element pattern 23 and the ground pattern 22 are connected to a signal line Ls and a grounding line Lg, respectively, of the cable 41.

FIGS. 2, 3, 4A, and 4B are diagrams for explaining an attachment structure of the antenna device 20 according to an embodiment of the present invention.

According to the attachment structure of the antenna device 20 of this embodiment, the antenna device 20 is fixed to an antenna attachment section 12 (FIGS. 4A and 4B) using a double-faced tape 30 made of, for example, a dielectric material. The antenna attachment section 12 may be a notch defined by a conductive section 11 of an electronic device 10.

Examples of the conductive section 11 of the electronic device 10 may include a housing, a circuit board, a frame, a shielding plate, and a shielding section.

The ground pattern 22 of the antenna device 20 is disposed over and attached to a conductive section 11 of the electronic device 10 by interposing the double-faced tape 30. In the antenna device 20, the ground pattern 22 is covered with an insulating resin material (dielectric material) such that the conductive section 11 and the ground pattern 22 are electromagnetically coupled to each other.

According to the antenna attachment structure of this embodiment, the conductive section 11 can serve as the ground section 22, so that it is possible to provide the same VSWR gain as the VSWR gain of an antenna device having a ground section length of approximately λ/4 or greater, i.e., approximately 20 mm or greater, or it is possible to minimize degradation.

According to the present embodiment, the antenna device 20, in which the ground pattern 22 and the element pattern 23 are formed on the substrate 21, can be attached to the antenna attachment section 12 in the conductive section 11 of the electronic device 10 such that the ground pattern 22 is disposed substantially over the conductive section 11. Therefore, the antenna device 20 can be mounted in the electronic device 10 in a manner such that the ground pattern 22 of the antenna device 20 does not project out of the conductive section 11 of the electronic device 10, namely, the housing, the circuit board, the frame, the shielding plate, and the shielding section of the electronic device 10. Accordingly, it is possible to reduce the length of the antenna device 20 projecting out of the conductive section 11.

The conductive section 11 of the electronic device 10 can serve as a ground of the antenna device 20, and it is therefore possible to downsize the ground pattern 22. The portion where the ground pattern 22 is formed can be used as an attachment section to the electronic device 10, so that it is possible to downsize the antenna device 20. The element pattern 23 is configured to project out of the conductive section 11, so that it is possible to prevent degradation of the performance of the antenna device 20.

Accordingly, it impossible to attach the antenna device 20 to the electronic device 10 using a reduced attachment space without degrading the antenna performance.

Since the conductive section 11 can serve as the ground section 22, even if the length of the ground section 22 is made less than λ/4 as illustrated in this embodiment, it is possible to provide the same antenna performance as an antenna device having a ground section length of approximately λ/4 or greater, i.e., approximately 20 mm or greater, or it is possible to minimize degradation.

In this embodiment, the antenna attachment section 12 is an angular U-shaped notch defined by a side of the conductive section 11. However, the side of the conductive section 11 does not need to have a notch having the angular U-shape.

Figure 5C:
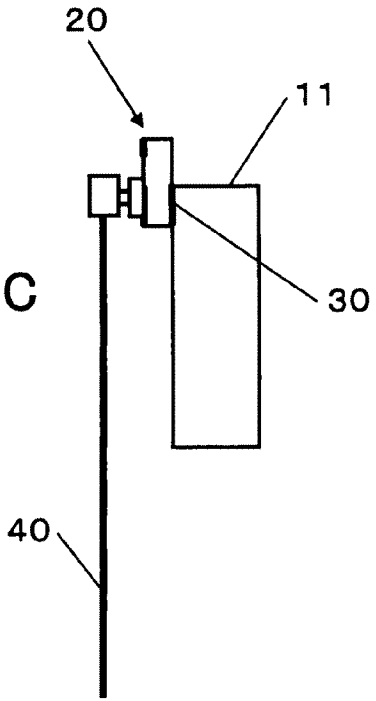
FIGS. 5A-5C are diagrams illustrating the configuration of a part of an antenna device according to another embodiment of the present invention.
Figure 5A:
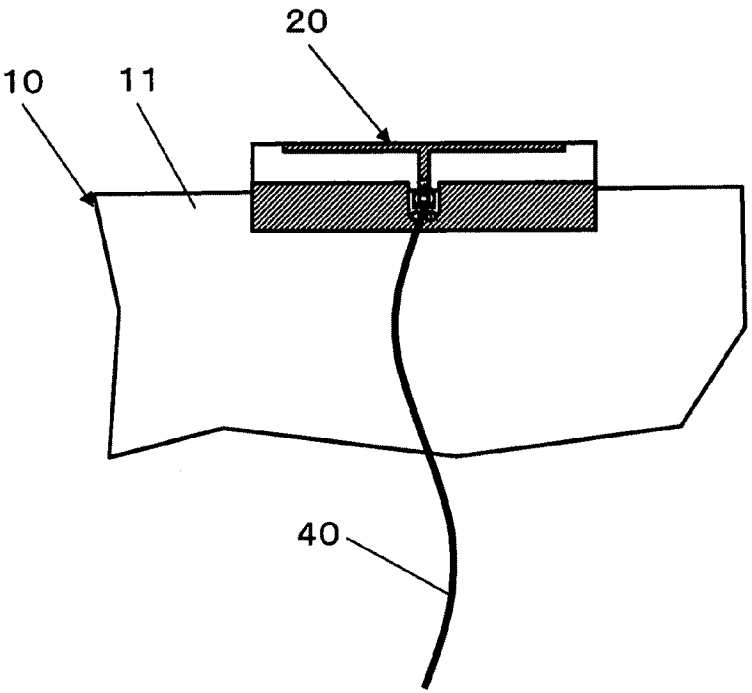
Figure 5B:
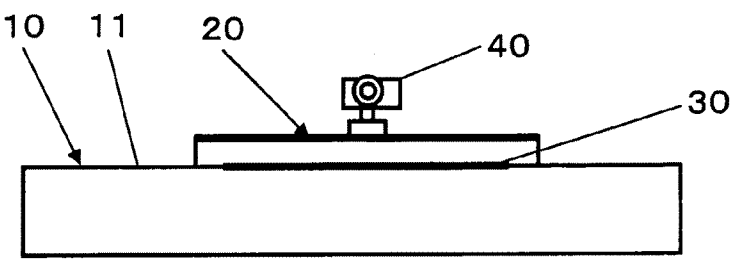

FIGS. 5A-5C are diagrams illustrating the configuration of a part of the antenna device 20 according to another embodiment of the present invention.

According to this embodiment, a portion of the antenna device 20 where the ground pattern 22 is formed is fixed to a side of the conductive section 11 of the electronic device 10. Therefore, only the element pattern 23 projects out of the side of the conductive section 11 of the electronic device 10. Accordingly, it is possible not only to reduce the length of the antenna device 20 projecting out of the conductive section 11 but also to prevent degradation of the performance of the antenna device 20.

Figure 6:
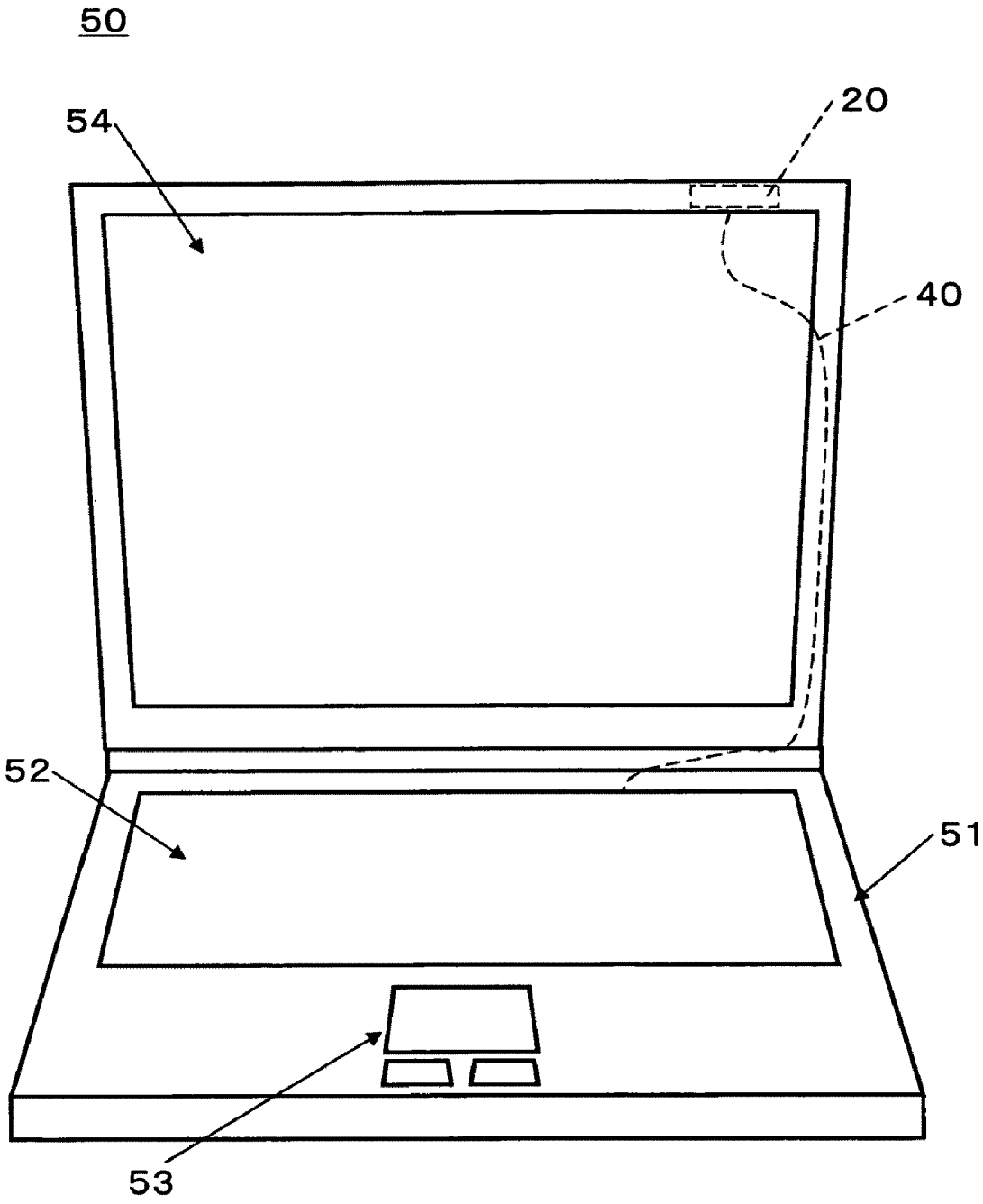
FIG. 6 is a diagram illustrating an application example of an embodiment of the present invention.

FIG. 6 is a schematic perspective view illustrating an application example of the antenna device 20 of the above-described embodiment of the present invention.

In this application example, the antenna device 20 is mounted in a notebook computer 50.

In the notebook computer 50, a keyboard 52 and a pointing device 53 are disposed in a main body 51. A display 54 is rotatably attached to the main body 51.

A bezel of the display 54 is made of a conductive material. An antenna attachment section, to which the antenna device 20 is attached, is formed in the bezel. Note that the antenna attachment section is provided at the upper end of the display 54 such that the antenna device 20 easily receives radio waves.

A coaxial cable 40 for connection of the antenna device 20 is introduced into the main body 51 through the backside of the display 54.

Figure 7:
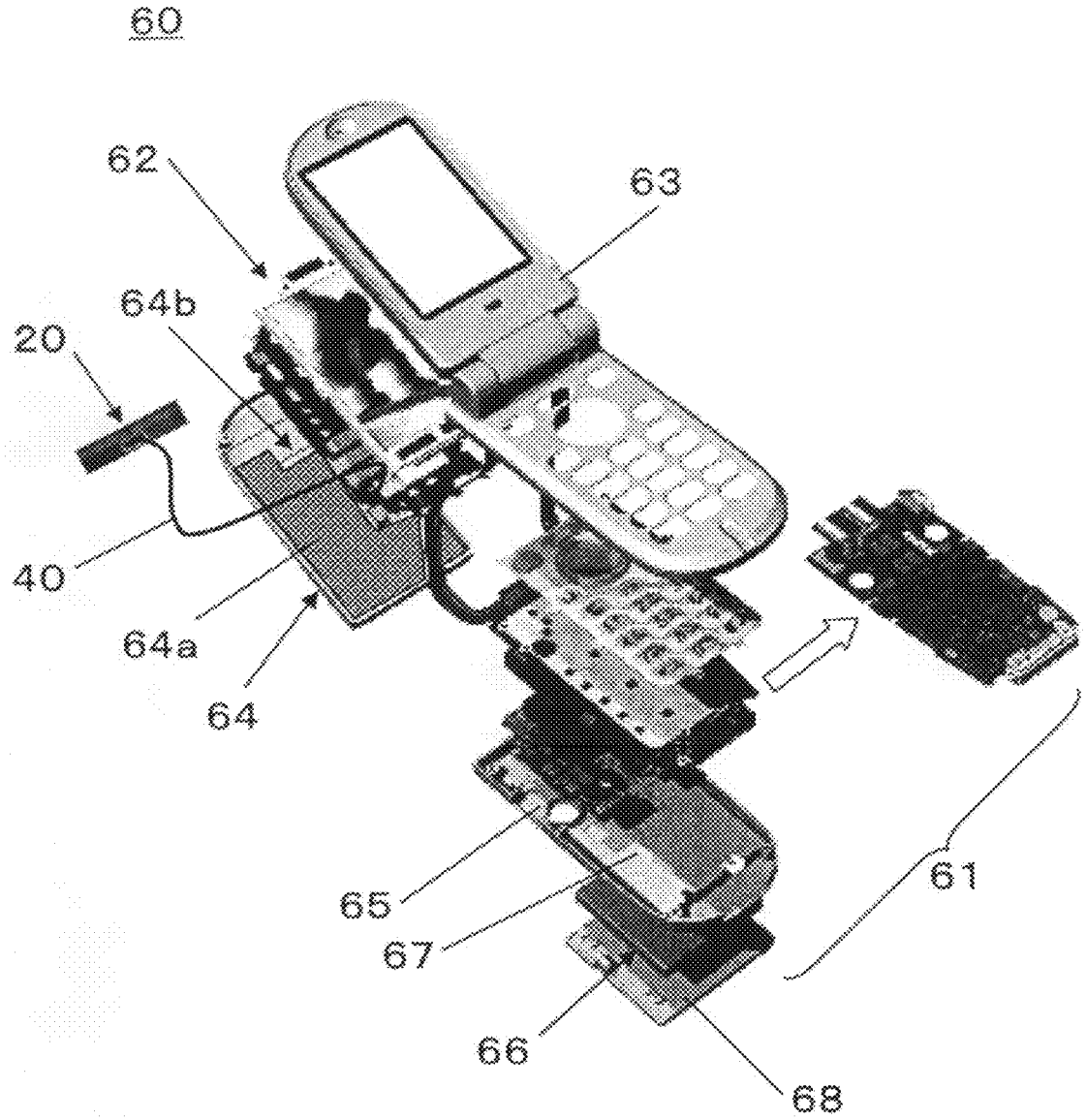
FIG. 7 is a diagram illustrating another application example of an embodiment of the present invention.

FIG. 7 is a schematic perspective view illustrating another application example of the antenna device 20 of the above-described embodiment of the present invention.

In this application example, the antenna device 20 is mounted in a mobile terminal 60.

In the mobile terminal 60, a main body 61 and a display 62 are accommodated in a casing 63 such that the display 62 is rotatable relative to the main body 61. The main body 61 includes a communication module, an input device, a processing unit, etc.

The backside of the casing 63 is covered with covers 64 and 65. Thus the main body 61 and the display 62 are accommodated inside the casing 63.

In the cover 65 is provided an accommodating section 67 for accommodating a battery 66. The battery 66 is accommodated in the accommodating section 67 of the cover 65 and is covered with a battery cover 68.

The antenna device 20 is attached to an antenna attachment section 64*b* formed by cutting a shielding conductive film 64*a*, which shielding conductive film 64*a* is formed on the inner surface of the cover 64. The antenna attachment section 64*b* has the same shape as the shape of the antenna attachment section 12 shown in FIGS. 4A and 4B, so that the antenna device 20 is attached to the antenna attachment section 64*b* in the same manner as described with reference to FIGS. 2, 3, 4A, and 4B.

The antenna device 20 may be applied not only to mobile phones but also to other mobile terminals such as portable digital assistants (PDAs).

The element pattern 23 of the antenna device 20 has a T-shape in the above-illustrated embodiments, but the same antenna characteristics can be provided even if the element pattern 23 has an L-shape.

Figure 8A:
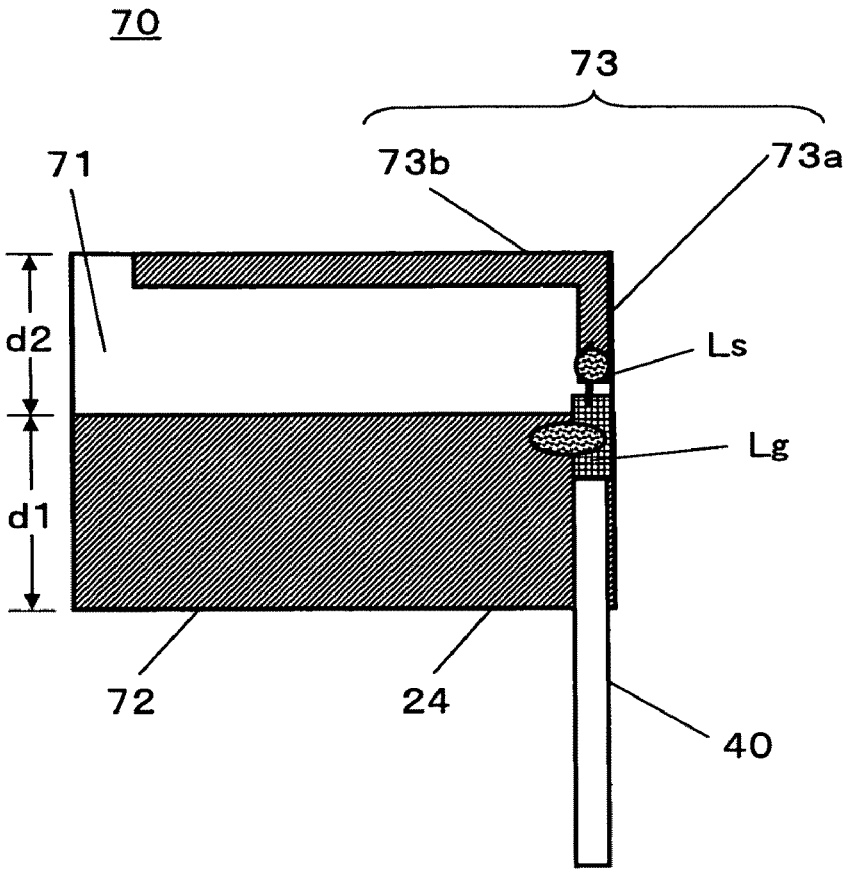
FIGS. 8A and 8B are diagrams illustrating the configuration of an antenna device according to a modified embodiment of the present invention.
Figure 8B:
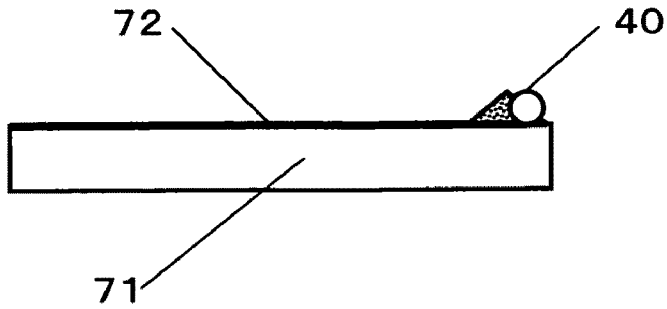

FIGS. 8A and 8B are diagrams illustrating the configuration of an antenna device 70 according to a modified embodiment of the present invention.

In the antenna device 70 of the modified embodiment, a ground pattern 72 and an element pattern 73 of a conductive material are formed on a substrate 71. A coaxial cable 40 is soldered to the ground pattern 72 and the element pattern 73.

For example, the substrate 71 is made of a resin board, such as a polyimide board, and has a width of about 15 mm, a depth of about 10 mm, and a thickness of about 0.1 mm. The substrate 71 may be made of a flexible resin (dielectric) film such as a PET film.

The ground pattern 72 is a ground section of the antenna device 70 and is made of a conductive film. The ground pattern 72 is formed across substantially the entire length of the substrate 71 in the width direction and substantially half the length of the substrate 71 in the depth direction. The element pattern 73 is an element section of the antenna device 70 and is made of a conductive film having a width of about 1 mm or less. The element pattern 73 has a first element portion 73*a* and a second element portion 73*b*. The first element portion 73*a* projects from the ground pattern 72 of the substrate 71 in the direction substantially orthogonal to a side of the ground pattern 72. The second element portion 73*b* is connected to an end of the first element portion 73*a* and is aligned substantially parallel to the side of the ground pattern 72. The conductive material forming the ground pattern 72 and the element pattern 73 may be, for example, a metal material such as copper and aluminum.

An end of the second element portion 73*b* is connected to an end of the first element portion 73*a*, while the other end of the second element portion 73*b* is an open end. Thus the first and second element portions 73*a* and 73*b* form the element pattern 73 having an L-shape. The L-shaped element pattern 73 electromagnetically acts on the ground pattern 72, thereby enabling transmission and reception of radio waves.

Note that the second element portion 73*b* has an element length of about 12 mm parallel to the side of the ground pattern 22 and is spaced apart from the side of the ground pattern 72 by about 4 through 5 mm.

A grounding line Lg of the coaxial cable 40 is directly soldered to the ground pattern 72, while a signal line Ls of the coaxial cable 40 is directly soldered to the element pattern 73. A coaxial connector as shown in FIGS. 1A and 1B may alternatively be used for the connections.

The ground pattern 72 of the antenna device 70 is disposed over and attached to a conductive section 11 of an electronic device 10 by interposing a double-faced tape 30 (see FIG. 2, 3, 4A and 4B).

Although the element patterns of the above-described embodiments and the modified embodiment have a T-shape and an L-shape, the shapes of the element patterns are not limited thereto. The element patterns may have any shape so long as the ground pattern is disposed over and attached to the conductive section 11 of the electronic device 10.

In an alternative embodiment, the ground section 22 and/or the element section 23 may be formed by molding a metal material. For example, the ground section 22 and the element section 23 may be formed by punching a metal sheet. In another alternative embodiment, the ground section 22 may be a conductive pattern formed on the substrate 21 while the element section 23 may be connected by soldering, welding or bending a metal wire. This can improve the productivity of manufacturing the antenna device.

The present invention is not limited to the above-described embodiments and variations and modifications may be made without departing from the scope of the invention.

The present application is based on Japanese Priority Application No. 2007-311451 filed on Nov. 30, 2007, with the Japanese Patent Office, the entire contents of which are hereby incorporated herein by reference.

What is claimed is:

1. An antenna device, comprising:

a ground section; and an element section projecting from within the ground section;

wherein a length of the ground section in a direction orthogonal to a side of the ground section from which side the element section projects is less than approximately ¼ a corresponding wavelength; and the ground section is configured to be disposed over and attached to a conductive section by interposing a conductive pasting material, wherein a length of the element section projecting from the ground section is less than approximately ¼ a corresponding wavelength, and the conductive section serves as the ground section and maintains antenna performance, and where the ground section has an angular U-shaped notch, and the notch has a connector attachment section, and the ground section extends substantially over a half width of a substrate, and a coaxial socket connector is attached to the connector attachment section.

2. The antenna device as claimed in claim 1, wherein the conductive pasting material is a conductive double-faced tape.

3. The antenna device as claimed in claim 1, wherein length of the element section is increased to allow reducing a projecting length of the element section.

4. The antenna device as claimed in claim 1, wherein the ground section and the conductive section are electromagnetically coupled to each other.

5. The antenna device as claimed in claim 1, wherein a portion of the antenna device has the ground section fixed to a side of the conductive section of an electronic device.

6. An antenna device, comprising:

a ground section; and an element section projecting from within the ground section;

wherein a length of the ground section in a direction orthogonal to a side of the ground section from which side the element section projects is less than approximately ¼ a corresponding wavelength; and the ground section is configured to be disposed over and attached to a conductive section by interposing a conductive pasting material, wherein the ground section and the element section are conductive patterns formed on a flexible substrate, and the conductive section serves as the ground section and maintains antenna performance, and where the ground section has an angular U-shaped notch, and the notch has a connector attachment section, and the ground section extends substantially over a half width of a substrate, and a coaxial socket connector is attached to the connector attachment section.

7. The antenna device as claimed in claim 6, wherein the element section includes a first element portion projecting from the side of the ground section; and a second element portion connected to an end of the first element portion and extending parallel to the side of the ground section.

8. The antenna device as claimed in claim 7, wherein the second element portion extends from the end of the first element portion away from opposite sides of the first element portion.

9. The antenna device as claimed in claim 7, wherein the second element portion extends from the end of the first element portion away from a side of the first element portion.

10. The antenna device as claimed in claim 7, wherein the antenna device is an ultra wide band device in a frequency band of 3.1-10.6 GHz.

11. The antenna device as claimed in claim 6, wherein the conductive section is a bezel of a display unit.

12. The antenna device as claimed in claim 6, wherein the ground section and the element section are formed by molding a metal material.

13. The antenna device as claimed in claim 6, wherein the flexible substrate is a printed wiring board.

14. The antenna device as claimed in claim 6, wherein length of the element section is increased to allow reducing a projecting length of the element section.

15. The antenna device as claimed in claim 6, wherein the ground section is formed across substantially the entire length in a width direction and substantially half the length in a depth direction of the flexible substrate.

16. The antenna device as claimed in claim 6, wherein a portion of the antenna device has the ground section fixed to a side of the conductive section of an electronic device.

17. An ultra wide band antenna device, comprising:

a ground section; and an element section projecting from within the ground section, wherein a length of the ground section in a direction orthogonal to a side of the ground section from which the element section projects is less than approximately ¼ a corresponding wavelength, and the ground section is on a conductive section by interposing a conductive pasting material and the ground section and the element section are conductive patterns formed on a flexible substrate, and the conductive section serves as the ground section and maintains antenna performance, and where the ground section has an angular U-shaped notch, and the notch has a connector attachment section, and the ground section extends substantially over a half width of a substrate, and a coaxial socket connector is attached to the connector attachment section.

18. The ultra wide band antenna device as claimed in claim 17, wherein the ultra wide band antenna device operates in a frequency band of 3.1-10.6 GHz.

19. The ultra wide band antenna device as claimed in claim 17, wherein length of the element section is increased to allow reducing a projecting length of the element section.

* * * * *